US006590557B1

(12) United States Patent
Seike

(10) Patent No.: US 6,590,557 B1
(45) Date of Patent: Jul. 8, 2003

(54) DISPLAY DEVICE AND DRIVING METHOD THEREFOR

(75) Inventor: Takeshi Seike, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 394 days.

(21) Appl. No.: 09/709,555

(22) Filed: Nov. 13, 2000

(30) Foreign Application Priority Data

Nov. 22, 1999 (JP) ..... 11-332108
Sep. 21, 2000 (JP) ..... 2000-287791

(51) Int. Cl.[7] ..... G09G 3/36
(52) U.S. Cl. ..... 345/94; 345/204
(58) Field of Search ..... 345/50, 51, 84, 345/87, 88, 90, 92, 93, 94, 95, 99, 100, 103, 104, 204, 205, 206, 211, 214

(56) References Cited

U.S. PATENT DOCUMENTS 5,684,503 A * 11/1997 Nomura et al. ..... 345/97
6,069,448 A * 5/2000 Yeh ..... 315/149
6,118,221 A * 9/2000 Kumasaka et al. ... 315/208 PZ
6,157,143 A * 12/2000 Bigio et al. ..... 315/307
6,388,388 B1 * 5/2002 Weindorf et al. ..... 315/169.3

FOREIGN PATENT DOCUMENTS

JP 05-53092 3/1993

* cited by examiner

*Primary Examiner*—Bipin Shalwala
*Assistant Examiner*—Mansour M. Said
(74) *Attorney, Agent, or Firm*—Birch, Stewart, Kolasch & Birch, LLP

(57) ABSTRACT

A method for driving a display device having a pair of substrates disposed so as to face each other with a display medium inserted therebetween, comprising altering an a amplitude of a supply voltage applied to each of the pixels during a selection period and an amplitude of a modulated voltage applied to each of the pixels during a nonselection period, corresponding to an ambient temperature level, wherein the amplitude of the supply voltage and the amplitude of the modulated voltage are decreased in a case where the ambient temperature increases, and the amplitude of the supply voltage and the amplitude of the modulated voltage are increased in a case where the ambient temperature decreases, and the rate of amplitude change of the modulated voltage to the change of the ambient temperature is greater than the rate of amplitude change of the supply voltage to the change of the ambient temperature.

12 Claims, 12 Drawing Sheets

DISPLAY DEVICE AND DRIVING METHOD THEREFOR

BACKGROUND OF THE INVENTION

1. Field of the Invention

The present invention relates to a display device such as a liquid crystal display device used for AV (audio and visual) apparatuses and OA (office automation) apparatuses, and a method for driving such a display device. More specifically, the present invention also relates to a display device incorporating dual-terminal nonlinear elements and a method for driving such a display device, in which appropriate corrections are performed corresponding to an ambient temperature around the device and corresponding to the characteristics of the elements.

2. Description of the Related Art

Recently, liquid crystal display devices are used for a variety of purposes, for example, as display devices for AV and OA apparatuses. Low-end apparatuses incorporate passive type liquid crystal display devices such as TN (twisted-nematic) display device and STN (super-twisted-nematic) display device. High quality apparatuses incorporate liquid crystal display devices driven according to an active matrix approach, in which three-terminal nonlinear elements represented by TFTs (thin-film-transistors) or dual-terminal nonlinear elements represented by MIMs (metal-insulator-metal) are used as switching elements.

Such liquid crystal display devices driven according to the active matrix approach provide thinner and lighter devices which have a color reproduction quality superior to that of CRTs (cathode-ray-tube), and reduced power consumption, and therefore use of such liquid crystal display devices is rapidly increasing. Using TFTs as switching elements, however, requires 6 to 8 steps of thin film forming processes and photolithography processes during production of the display devices. Therefore, solutions for cost reduction are highly sought.

On one hand, liquid crystal display devices incorporating dual-terminal nonlinear elements as switching elements have been developed rapidly since they are advantageous to TFTs in terms of cost and advantageous to passive type liquid crystal display devices in terms of display quality.

The dual-terminal nonlinear element is known for changing its characteristics depending on an ambient temperature. As illustrated in FIG. 2, when the ambient temperature increases, the characteristics of the dual-terminal nonlinear element change from the characteristics indicated by a solid line a to characteristics indicated by a dashed line b, i.e., to low resistance characteristics, and when the ambient temperature decreases, the characteristics of the dual-terminal nonlinear element change from the characteristics indicated by a solid line a to characteristics indicated by a dashed line c, i.e., to high resistance characteristics.

As the characteristics of the dual-terminal nonlinear element change depending on the ambient temperature, a voltage-transmittance characteristic of the display device incorporating the dual-terminal nonlinear element also changes depending on the ambient temperature. This means that the display condition of the display device changes depending on the ambient temperature, which is a fatal problem for display devices used in certain temperature ranges.

In order to improve such a temperature characteristic of the dual-terminal nonlinear element, studies has been made for obtaining a better material and a better structure for the dual-terminal nonlinear element, but no outstanding effects have as yet been achieved. Another solution is to incorporate an independent heating device or a cooling device together with the display device so as to maintain the display section at a constant temperature. This, however, increases the cost and the size of the apparatus.

As methods for improving the temperature characteristic by means of changing the manner in which the display is driven, it has been conventional to change a driving voltage value or a bias value applied to the liquid crystal. Regarding a display device incorporating dual-terminal nonlinear elements, for example, Japanese Laid-open Publication No. 5-53092 discloses a driving method in which a rate of change depending on the temperature is varied between a bias potential, a data amplitude voltage, and the maximum selection potential. In Japanese Laid-open Publication No. 5-53092, the maximum selection potential means the maximum potential during a selection period, the bias potential means the time average of the potential during a nonselection period, and the data amplitude voltage means the difference of the selected pulse between operation time and nonoperation time of the liquid crystal panel. A correction of the temperature is performed based on the following three criteria: (1) the bias potential is always at a non-zero value; (2) the temperature-dependent variation rate of the maximum selection potential is set to be greater than the temperature-dependent variation rate of the bias potential; and (3) the temperature-dependent variation rate of the data amplitude voltage is set to be smaller than the temperature-dependent variation rate of the maximum selection potential.

The above method, however, requires alteration of the bias potential during a nonselection period, and therefore requires a variety of potentials. It may also increase the power consumption since the energy loss in the power supply circuit is great due to the variable amplitudes.

Moreover, it is difficult in the above method to change the characteristics of dual-terminal nonlinear element so as to obtain display devices for specified uses, e.g., display devices emphasizing uniformity, display devices emphasizing contrast, or the like.

SUMMARY OF THE INVENTION

In one aspect of the invention, a method for driving a display device includes a pair of substrates disposed so as to face each other with a display medium inserted therebetween, one of the substrates including: a first wiring of either a plurality of scanning lines or a plurality of signal lines; and at least one dual-terminal nonlinear element which is connected to the first wiring and functions as a switching element for selecting matrix-like pixels, and the other substrate including a second wiring of the other of the plurality of scanning lines or the plurality of signal lines provided in a direction perpendicular to the first wiring, the method including the step of altering an amplitude of a supply voltage applied to each of the pixels during a selection period and an amplitude of a modulated voltage applied to each of the pixels during a nonselection period, corresponding to an ambient temperature level, wherein the amplitude of the supply voltage and the amplitude of the modulated voltage are decreased in a case where the ambient temperature increases, and the amplitude of the supply voltage and the amplitude of the modulated voltage are increased in a case where the ambient temperature decreases, and the rate of amplitude change of the modulated voltage to the change of the ambient temperature is greater than the rate of amplitude change of the supply voltage to the change of the ambient temperature.

In another aspect of the invention, a method for driving a display device includes a pair of substrates disposed so as to face each other with a display medium inserted therebetween, one of the substrates including: a first wiring of either a plurality of scanning lines or a plurality of signal lines; and at least one dual-terminal nonlinear element which is connected to the first wiring and functions as a switching element for selecting matrix-like pixels, and the other substrate including a second wiring of the other of the plurality of scanning lines or the plurality of signal lines provided in a direction perpendicular to the first wiring, the method including the step of altering a pulse width of a supply voltage applied to each of the pixels during a selection period and a pulse width of a modulated voltage applied to each of the pixels during a nonselection period, corresponding to an ambient temperature, wherein the pulse width of the supply voltage and the pulse width of the modulated voltage are decreased in a case where the ambient temperature increases, and the pulse width of the supply voltage and the pulse width of the modulated voltage are increased in a case where the ambient temperature decreases.

In another aspect of the invention, a method for operating a display device includes a pair of substrates disposed so as to face each other with a display medium inserted therebetween, one of the substrates including: a first wiring of either a plurality of scanning lines or a plurality of signal lines; and at least one dual-terminal nonlinear element which is connected to the first wiring and functions as a switching element for selecting matrix-like pixels, and the other substrate including a second wiring of the other of the plurality of scanning lines or the plurality of signal lines provided in a direction perpendicular to the first wiring, the method including the step of altering an amplitude of a supply voltage applied to each of the pixels during a selection period and a pulse width of a modulated voltage applied to each of the pixels during a nonselection period, corresponding to an ambient temperature level, wherein the amplitude of the supply voltage and the pulse width of the modulated voltage are decreased in a case where the ambient temperature increases, and the amplitude of the supply voltage and the pulse width of the modulated voltage are increased in a case where the ambient temperature decreases.

In another aspect of the invention, a method for driving a display device includes a pair of substrates disposed so as to face each other with a display medium inserted therebetween, one of the substrates including: a first wiring of either a plurality of scanning lines or a plurality of signal lines: and at least one dual-terminal nonlinear element which is connected to the first wiring and functions as a switching element for selecting matrix-like pixels, the other substrate including a second wiring of the other of the plurality of scanning lines or the plurality of signal lines provided in a direction perpendicular to the first wiring, the method including the step of altering a pulse width of a supply voltage applied to each of the pixels during a selection period and an amplitude of a modulated voltage applied to each of the pixels during a nonselection period, corresponding to an ambient temperature level, wherein the pulse width of the supply voltage and the amplitude of the modulated voltage are decreased in a case where the ambient temperature increases, and the pulse width of the supply voltage and the amplitude of the modulated voltage are increased in a case where the ambient temperature decreases.

In another aspect of the invention, a method for driving a display device includes a pair of substrates disposed so as to face each other with a display medium inserted therebetween, one of the substrates including: a first wiring of either a plurality of scanning lines or a plurality of signal lines; and at least one dual-terminal nonlinear element which is connected to the first wiring and functions as a switching element for selecting matrix-like pixels, the other substrate including a second wiring of the other of the plurality of scanning lines or the plurality of signal lines provided in a direction perpendicular to the first wiring, wherein the amplitude of the supply voltage and the amplitude of the modulated voltage are altered corresponding to a current/voltage characteristic of the at least one dual-terminal nonlinear element, and wherein the amplitude of the supply voltage and the amplitude of the modulated voltage are increased in a case where the current/voltage characteristic of the dual-terminal nonlinear element is set to a high resistance current/voltage characteristic, and the amplitude of the supply voltage and the amplitude of the modulated voltage are decreased in a case where the current/voltage characteristic of the at least one dual-terminal nonlinear element is set to a low resistance current/voltage characteristic.

In one embodiment of the invention, the amplitude of the modulated voltage is in a range from 5 V to 15 V in a case where the current/voltage characteristic of the at least one dual-terminal nonlinear element is set so that a voltage value of the current/voltage characteristic is in a range from 5 V to 15 V at a current value of the current/voltage characteristic in a range of $1\times10^{-10}$ A to $1\times10^{-8}$ A, and the amplitude of the modulated voltage is in a range from 1 V to less than 5 V in a case where the current/voltage characteristic of the at least one dual-terminal nonlinear element is set so that the voltage value of the current/voltage characteristic is in a range from 1 V to less than 5 V at the current value of the current/voltage characteristic in a range from $1\times10^{-10}$ A to $1\times10^{-8}$ A.

In another embodiment of the invention, the at least one dual-terminal nonlinear element has a MIM structure.

Functions of the present invention will now be described.

According to the present invention, by individually controlling a correction waveform for a voltage applied to the scanning lines and a correction waveform for a voltage applied to the signal lines, it is possible to change, corresponding to the ambient temperature and the characteristics of a dual-terminal nonlinear element, the amplitude of a supply voltage applied to each pixel during a selection period and the amplitude of a modulated voltage applied to each pixel during a nonselection period.

The supply voltage applied during the selection period provides a voltage value capable of sufficiently charging a display medium (a liquid crystal layer) of each pixel, corresponding to the current-voltage characteristics (the I-V characteristics) of the dual-terminal nonlinear element. The modulated voltage applied during the nonselection period determines a maintenance characteristic. A synthesized voltage of the supply voltage and the modulated voltage determines the ON/OFF state of the display.

Since the I-V characteristics of the dual-terminal nonlinear element change corresponding to a temperature change, by changing the supply voltage and the modulated voltage corresponding to the change of the I-V characteristics, it is possible to achieve a sufficient correction effect of the I-V characteristics corresponding to the temperature change.

For example, in the case where the ambient temperature increases, the resistance characteristic of the dual-terminal nonlinear element decreases as shown in FIGS. 1A and 1B.

Therefore, the amplitude of the supply voltage and amplitude of the modulated voltage are both made to decrease. In the case where the ambient temperature decreases as shown in FIGS. 1A and 1B, the resistance characteristic of the dual-terminal nonlinear element increases. Therefore, the amplitude of the supply voltage and amplitude of the modulated voltage are both made to increase. In both FIGS. 1A and 1B, the current value is constant (e.g., $I=1\times10^{-6}$ A in FIG. 1A and $I=1\times10^{-11}$ A in FIG. 1B) while the I-V characteristics of the dual-terminal nonlinear element corresponding to the ambient temperature changes. As shown in these graphs, if the current value is constant, the display characteristic of the display medium (the liquid crystal layer) corresponding to the temperature change becomes substantially constant. In order to make the current value constant regardless of the ambient temperature change, the supply voltage and the modulated voltage have to be independently changed. Furthermore, since the voltage change regarding to the change of I-V characteristics corresponding to the temperature is greater in the case where the current value is low than in the case where the current value is high as shown in FIGS. 1A and 1B, the rate of amplitude change for the modulated voltage is made greater than that for the supply voltage, corresponding to the ambient temperature.

The I-V characteristics of the dual-terminal nonlinear element, having for example, an MIM structure, can be changed depending on the structure or the materials used, or the temperature conditions during manufacturing. The supply voltage and the modulated voltage can be changed corresponding to the change of the I-V characteristics. Therefore, it is possible to obtain a variety of display characteristics suitable for each specific use. For example, a display emphasizing uniformity, a display emphasizing contrast, or the like is obtained.

In the case where the resistance characteristic is that of a high resistance among the I-V characteristics of the dual-terminal nonlinear element, a high duty and high contrast display characteristic can be obtained by increasing the amplitude of at least one of the supply voltage or the modulated voltage. For example, if the dual-terminal nonlinear element has current-voltage characteristics in which the voltage value is in a range from 5 V to 15 V at the current value in a range from $1\times10^{-10}$ A to $1\times10^{-8}$ A, it is preferable to set the amplitude of the modulated voltage in a range from 5 V to 15 V. In the case where the resistance characteristic is low among the I-V characteristics of the dual-terminal nonlinear element, a display characteristic, in which the contrast in the display screen is uniform even at a low driving voltage, can be obtained by decreasing the amplitude of at least one of the supply voltage or the modulated voltage of the dual-terminal nonlinear element. As a result, it is possible to reduce the device cost by using driving members which have a low level voltage tolerance. For example, if the dual-terminal nonlinear element has current-voltage characteristic in which the voltage value is in a range from 1 V to less than 5 V at the current value in a range from $1\times10^{-10}$ A to $10^{-8}$ A, it is preferable to set the amplitude of the modulated voltage in a range from 1 V to less than 5 V.

Thus, the invention described herein makes possible the advantages of (1) providing a display device which is capable of preventing deterioration of the display quality due to an ambient temperature change, and selecting a suitable driving condition corresponding to changes in the characteristics of a dual-terminal nonlinear element, thereby achieving display characteristics suitable for each specific use; and (2) providing a method for driving the display device.

These and other advantages of the present invention will become apparent to those skilled in the art upon reading and understanding the following detailed description with reference to the accompanying figures.

DESCRIPTION OF THE PREFERRED EMBODIMENTS

Examples of the present invention will now be described with reference to the attached drawings. The dual-terminal nonlinear elements and the liquid crystals used in the following examples are, respectively, elements having an MIM structure and TN liquid crystals. The liquid crystal display panel used in the following examples is a liquid crystal display panel including 1024 data signal lines (signal lines) and 768 scanning signal lines (scanning lines), which is operated in a normally-white display mode. The present invention, however, is not limited to this configuration. Although in the following examples, the dual-terminal nonlinear elements are connected to the data signal lines, the present invention is also applicable to the case where the dual-terminal nonlinear elements are connected to the scanning signal lines.

EXAMPLE 1

Figure 3:
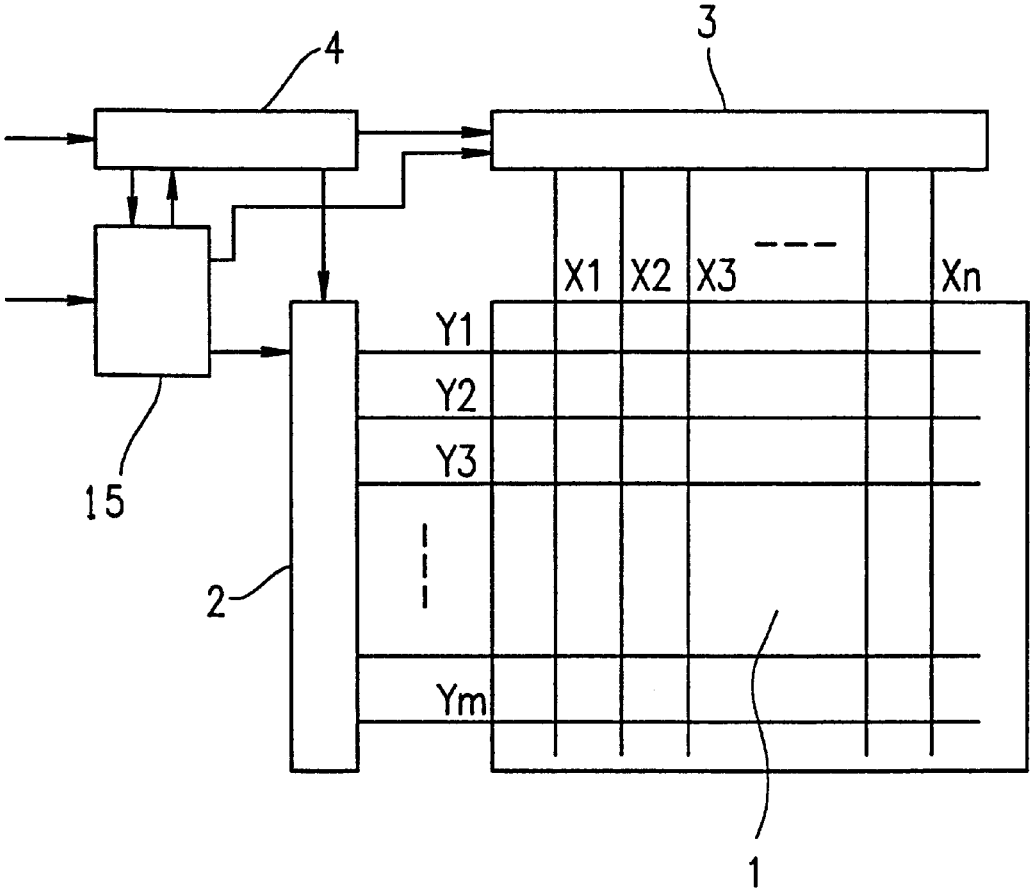
FIG. 3 is a schematic diagram illustrating a schematic structure of a display device according to an example of the present invention.
Figure 4:
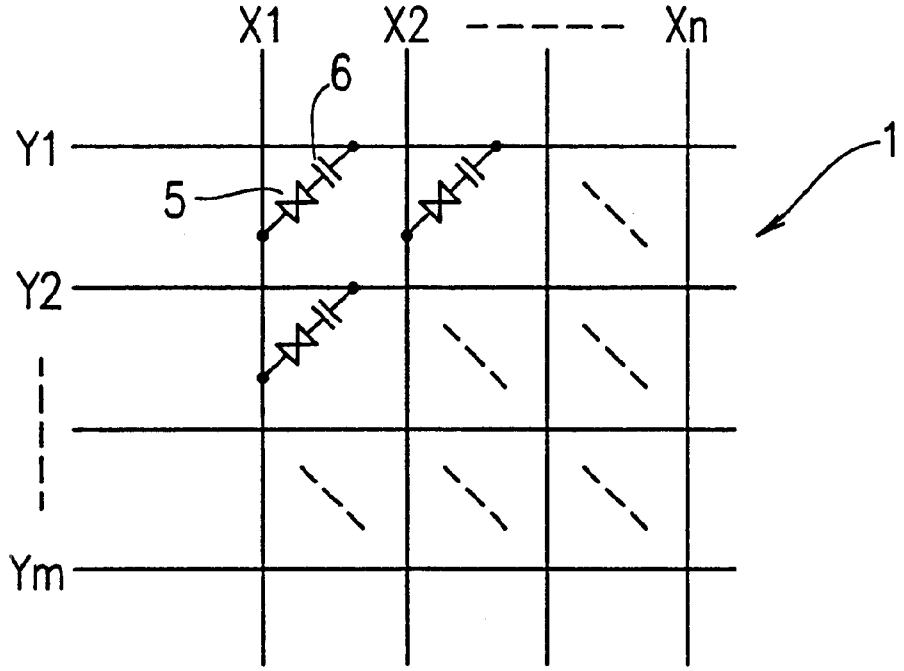
FIG. 4 illustrates an equivalent circuit showing a display panel of the display device according to an example of the present invention.

FIG. 3 is a schematic diagram illustrating a structure of a liquid crystal display device according to Example 1 of the present invention, and FIG. 4 illustrates an equivalent circuit showing the display panel section 1 of the device in FIG. 3. In this liquid crystal display device, the display panel section 1 includes a pair of substrates disposed so as to face each other with a liquid crystal layer 6 inserted therebetween. One of the substrates includes a plurality of data signal lines (X1 to Xn). The other substrate includes a plurality of scanning signal lines (Y1 to Ym) provided along a direction perpendicular to the direction along which the data signal lines extend. For each pixel arranged in a matrix a dual-terminal nonlinear element 5 as a switching element is provided and is serially connected to a liquid crystal layer 6.

A scanning signal line driving circuit section 2 is provided so as to apply a predetermined voltage to the scanning signal lines (Y1 to Ym) in the display panel section 1 in a line-sequential manner. The scanning signal line driving circuit section 2 generally includes a circuit for generating a power for driving liquid crystals, a shift resistor, an analog switch, etc. (not shown).

A data signal line driving circuit section 3 is provided so as to apply a predetermined voltage, which corresponds to each display image, to the data signal lines (X1 to Xn) of the display panel section 1. The data signal line driving circuit section 3 generally includes a shift resistor, a latch circuit, an analog switch, etc. (not shown).

A control section 4 is provided so as to send a control signal to the scanning signal line driving circuit section 2 and the data signal line driving circuit section 3, respectively, thereby displaying input information.

A voltage generation section 15 generates a liquid crystal.driving voltage, a modulated voltage to be applied to the data signal lines (X1 to Xn), a logic voltage to be applied to the control section 4, and the like.

Figure 1A:
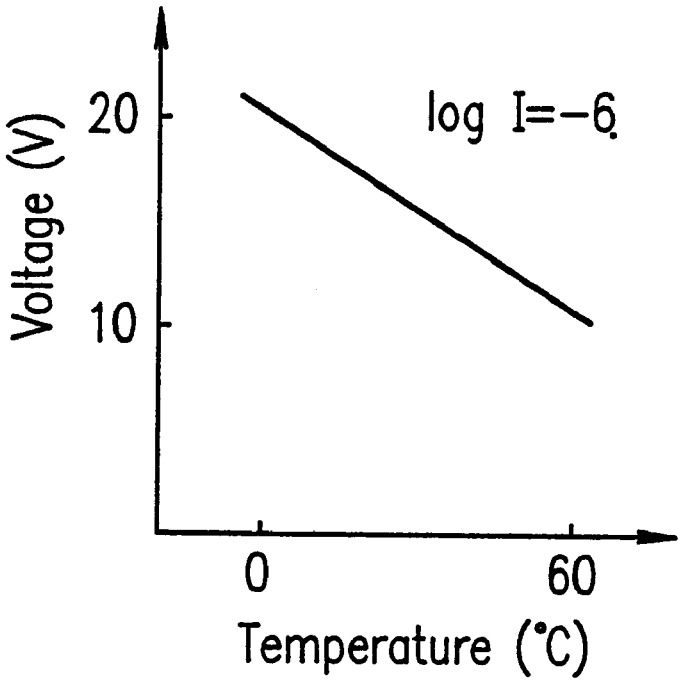
FIGS. 1A and 1B are graphs illustrating a relationship between voltages and temperatures necessary to apply a constant current to a dual-terminal nonlinear element.
Figure 1B:
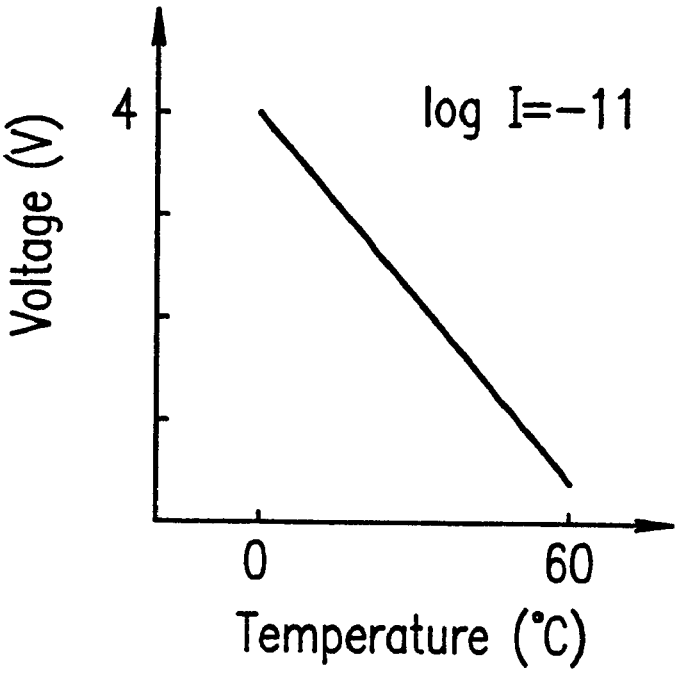
Figure 2:
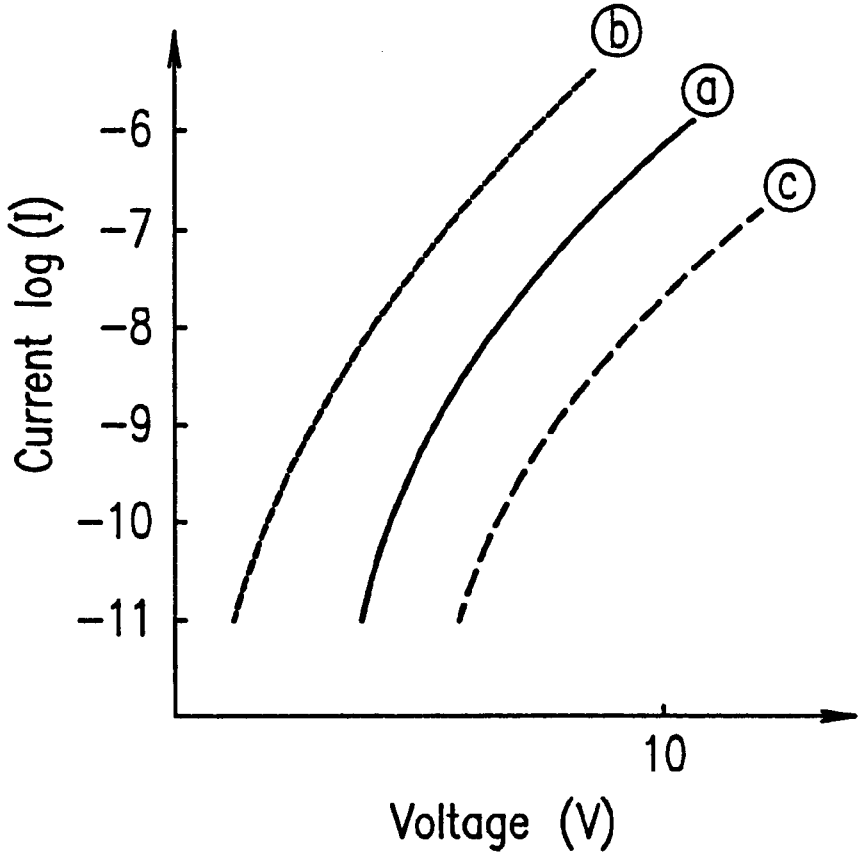
FIG. 2 is a graph illustrating a change in I-V characteristics of the dual-terminal nonlinear element corresponding to the temperature change.

FIG. 2 shows I-V characteristics of a dual-terminal nonlinear element. By using the I-V characteristics, pixels are turned ON or OFF corresponding to the display condition of each pixel during a selection period allotted to each pixel. Specifically, during a selection period, a high voltage is applied to the dual-terminal nonlinear element so as to make the dual-terminal nonlinear element low resistive, thereby charging or discharging the liquid crystal layer corresponding to each pixel. Other than selection periods (nonselection period), a low voltage is applied to the dual-terminal nonlinear element so as to turn the dual-terminal nonlinear element high resistive, thereby maintaining a charged or discharged state of each pixel.

As described above, according to the display device incorporating dual-terminal nonlinear elements, it is possible to maintain the charge of the liquid crystal layer corresponding to each pixel during the nonselection periods. As a result, high duty driving is achieved as compared to a simple matrix type display device.

Figure 5:
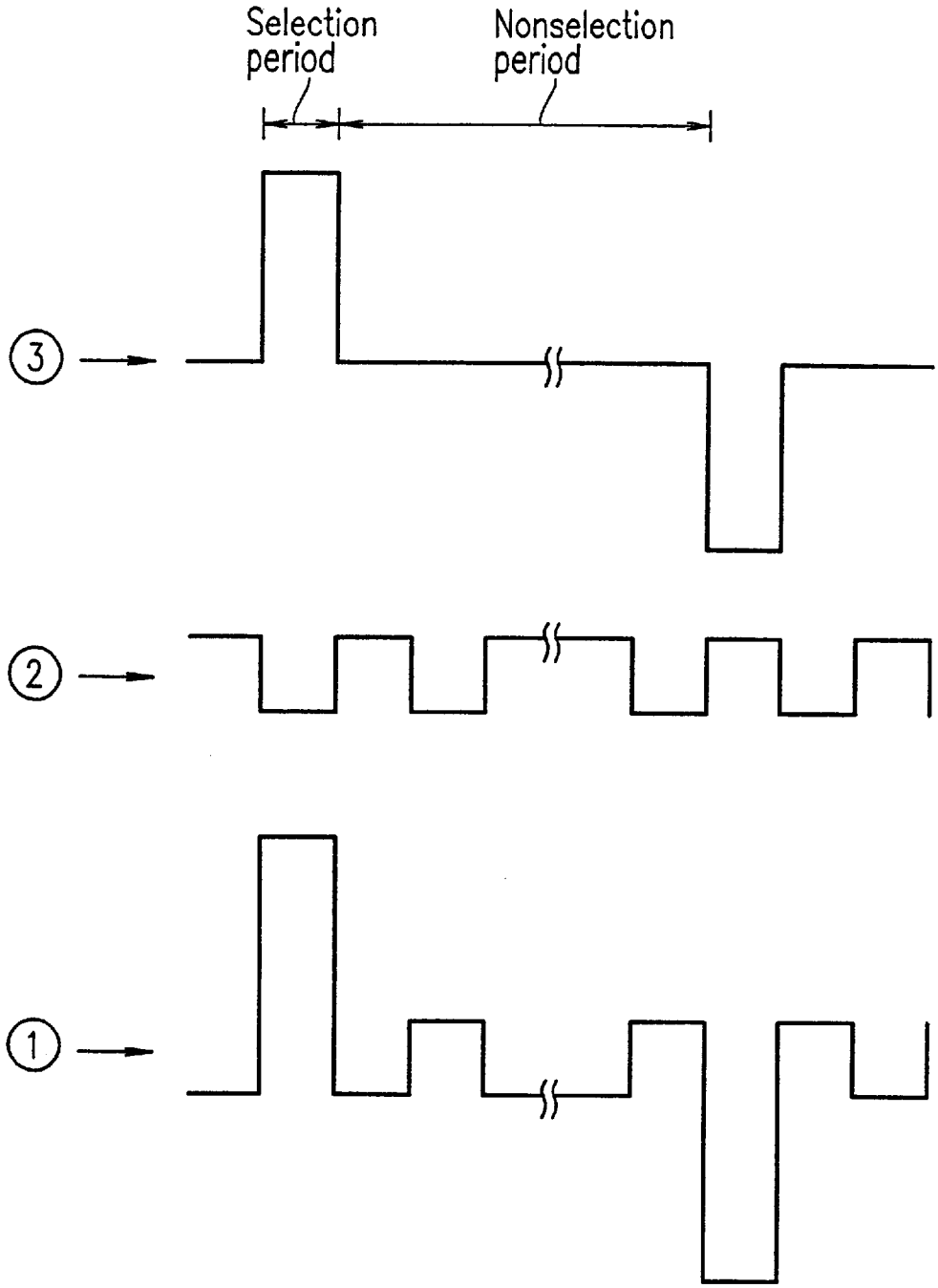
FIG. 5 illustrates waveforms of signals applied to the display device according to an example of the present invention.

FIG. 5 illustrates waveforms applied to the display device according to the present example of the invention. A signal as shown in ② of FIG. 5 is applied to the data signal lines, and a signal as shown in ③ of FIG. 5 is applied to the scanning signal lines, thereby applying a signal as shown in ① of FIG. 5, which is a synthesized signal of the signals ② and ③ of FIG. 5, to each pixel in the display panel section.

Figure 6:
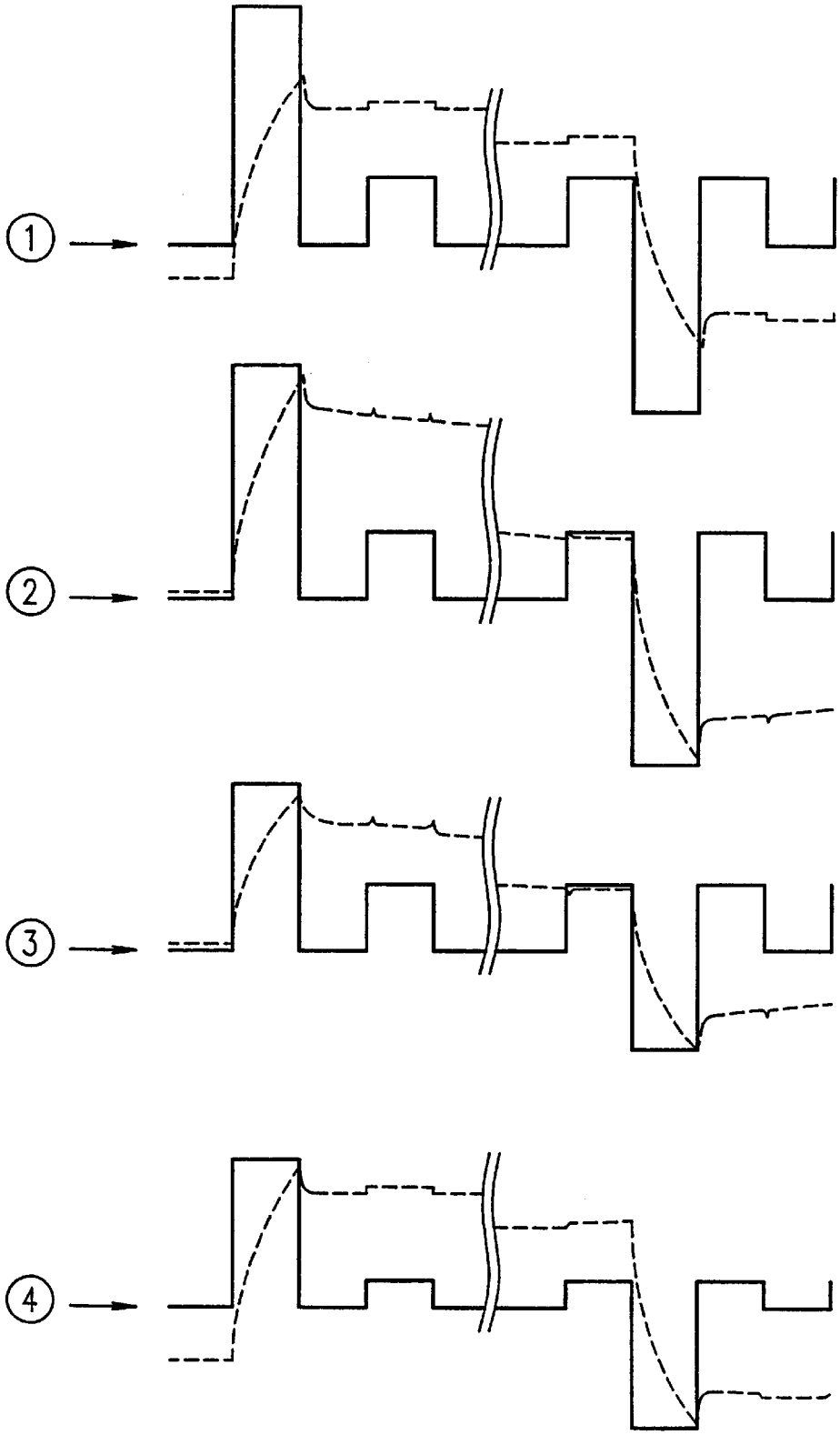
FIG. 6 illustrates wave forms of signals applied to the display device and voltages applied to the liquid crystal layers of the display device according to an example of the present invention.

Corresponding to the signal voltages applied to each pixel, a waveform indicated by a dashed line in ① of FIG. 6 is applied to the liquid crystal layer 6 portion of each pixel. As shown in FIG. 2, when the ambient temperature increases, the I-V characteristics of the dual-terminal nonlinear elements shift in a direction from the solid line a to the dashed line b, i.e., a low resistive direction. Therefore, if the signal voltages applied to the pixel is the same, the waveform indicated by the dashed line in ② of FIG. 6 is applied to the liquid crystal layer 6 portion of each pixel. Comparing the difference of the waveforms applied to the liquid crystal layer 6 portions of each pixel between when the ambient temperature is at a normal level and when the ambient temperature is high (i.e., comparing the difference between the dashed line in ① and the dashed line in ② of FIG. 6), it is understood that, in ② of FIG. 6, the signal voltage applied to the liquid crystal layer 6 is higher during the selection period, but a maintenance characteristic during the nonselection period is reduced.

Figure 8:
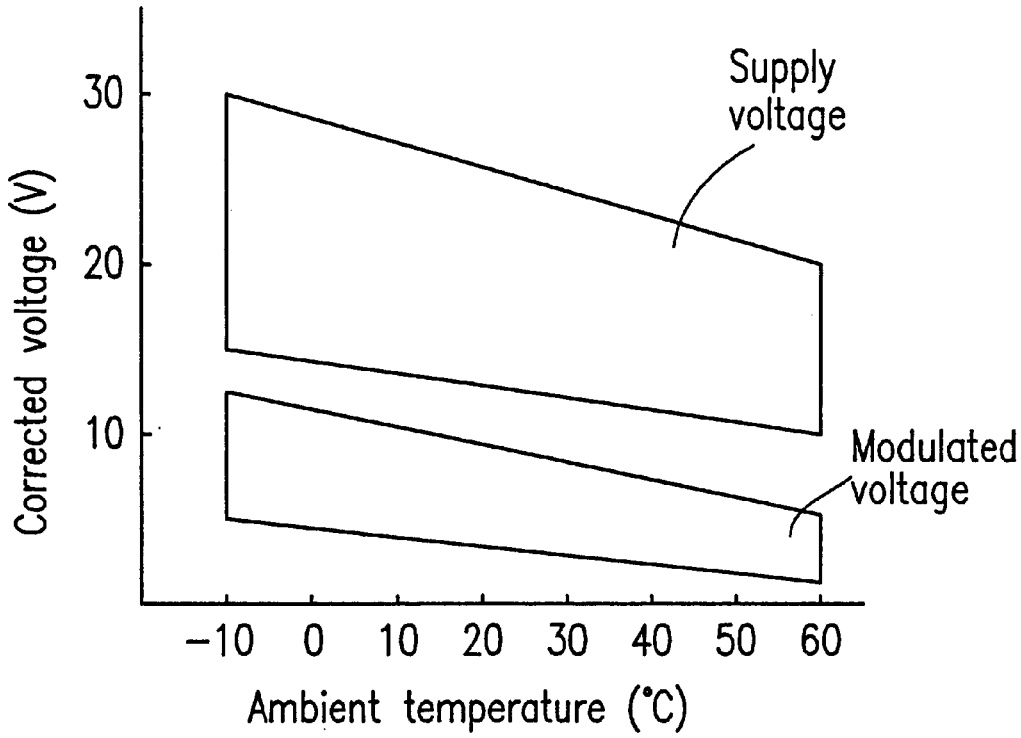
FIG. 8 is a graph illustrating the relationship between a correction voltage applied to the display device according to an example of the present invention and an ambient temperature.

Corresponding to the change in the temperature characteristic, only the supply voltage applied to each pixel during the selection period is decreased. Then, the waveform shown in the dashed line ③ of the FIG. 6 is applied to the liquid crystal layer 6 portion of each pixel. In order to apply a similar waveform as that shown in ① of FIG. 6 to the liquid crystal layer 6 portion of each pixel, the correction voltage for the scanning signal lines is then adjusted so that the modulated voltage applied to each pixel during the nonselection period is decreased corresponding to the temperature characteristic and the correction voltage for the data signal lines is adjusted so that the modulated voltage applied to the pixel during the nonselection period is decreased corresponding to the temperature characteristic. As shown in FIG. 8, amount of change of the voltage (correction voltage amount) is different between the supply voltage and the modulated voltage, i.e. the rate of change of the modulated voltage is greater than that of the supply voltage. This results in applying a waveform shown by the dashed line in ④ of FIG. 6 to the liquid crystal layer 6 portion of each pixel. Compared with the waveform shown by the dashed line in ② of FIG. 6, the waveform shown by the dashed line in ④ of FIG. 6 more closely resembles to the waveform shown by the dashed line in ① of FIG. 6.

Figure 7:
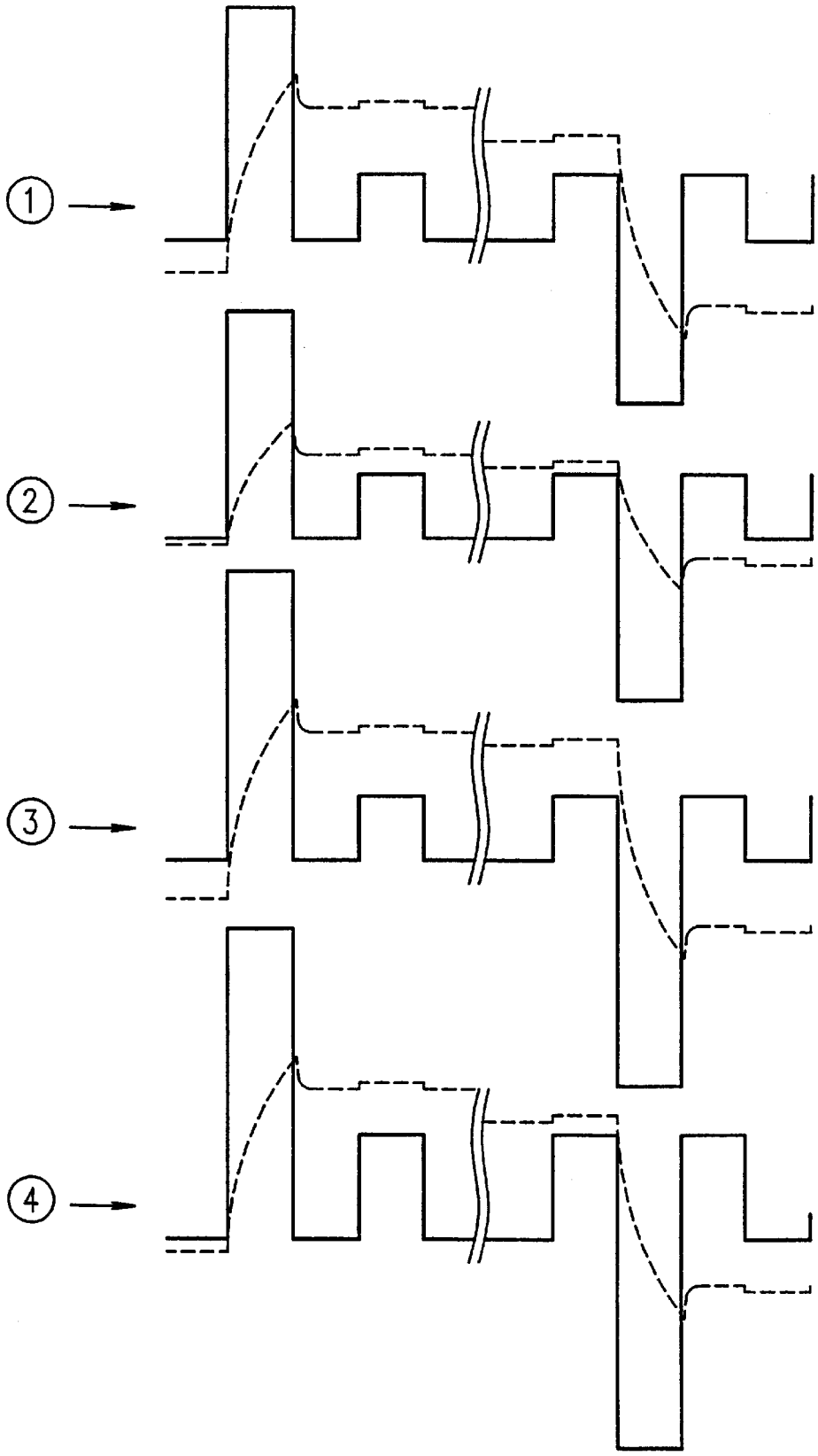
FIG. 7 illustrates waveforms of signals applied to the display device and voltages applied to the liquid crystal layers of the display device according to an example of the present invention.

On the other hand, as shown in FIG. 2, when the ambient temperature decreases, the I-V characteristics of the dual-terminal nonlinear elements shift in a direction from the solid line a to the dashed line c, i.e., a high resistive direction. Therefore, if the signal voltage applied to each pixel is the same, the waveform indicated by the dashed line in ② of FIG. 7 is applied to the liquid crystal layer 6 portion of each pixel. The difference of the waveforms applied to the liquid crystal layer 6 portion of each pixel between when the ambient temperature is at a normal level and when the ambient temperature is low (the difference between the dashed line in ① and the dashed line in ② of FIG. 7) has to be corrected again.

Corresponding to the change in the temperature characteristic, only the supply voltage applied to each pixel during the selection period is increased. Then, the waveform shown by the dashed line ③ of FIG. 7 is applied to the liquid crystal layer 6 portion of each pixel. In order to apply a waveform similar to that shown in ① of FIG. 7 to the liquid crystal layer 6 portion of each pixel, the correction voltage for the scanning signal lines is then adjusted so that the modulated voltage applied to each pixel during the nonselection period is increased corresponding to the temperature characteristic, and the correction voltage for the data signal lines is adjusted so that the modulated voltage applied to each pixel during the nonselection period is increased corresponding to the temperature characteristic.

Once again, in this case, as shown in FIG. 8, the amount of change of the voltage (correction voltage amount) is different between the supply voltage and the modulated voltage, i.e. the rate of change of the modulated voltage is greater than that of the supply voltage. This results in a waveform shown by the dashed line in ④ of FIG. 7 to be applied to the liquid crystal layer 6 portion of each pixel. The respective correction voltages for the row side (COM) and the column side (SEG) of the display device are created in the voltage generation section 15.

EXAMPLE 2

Figure 10:
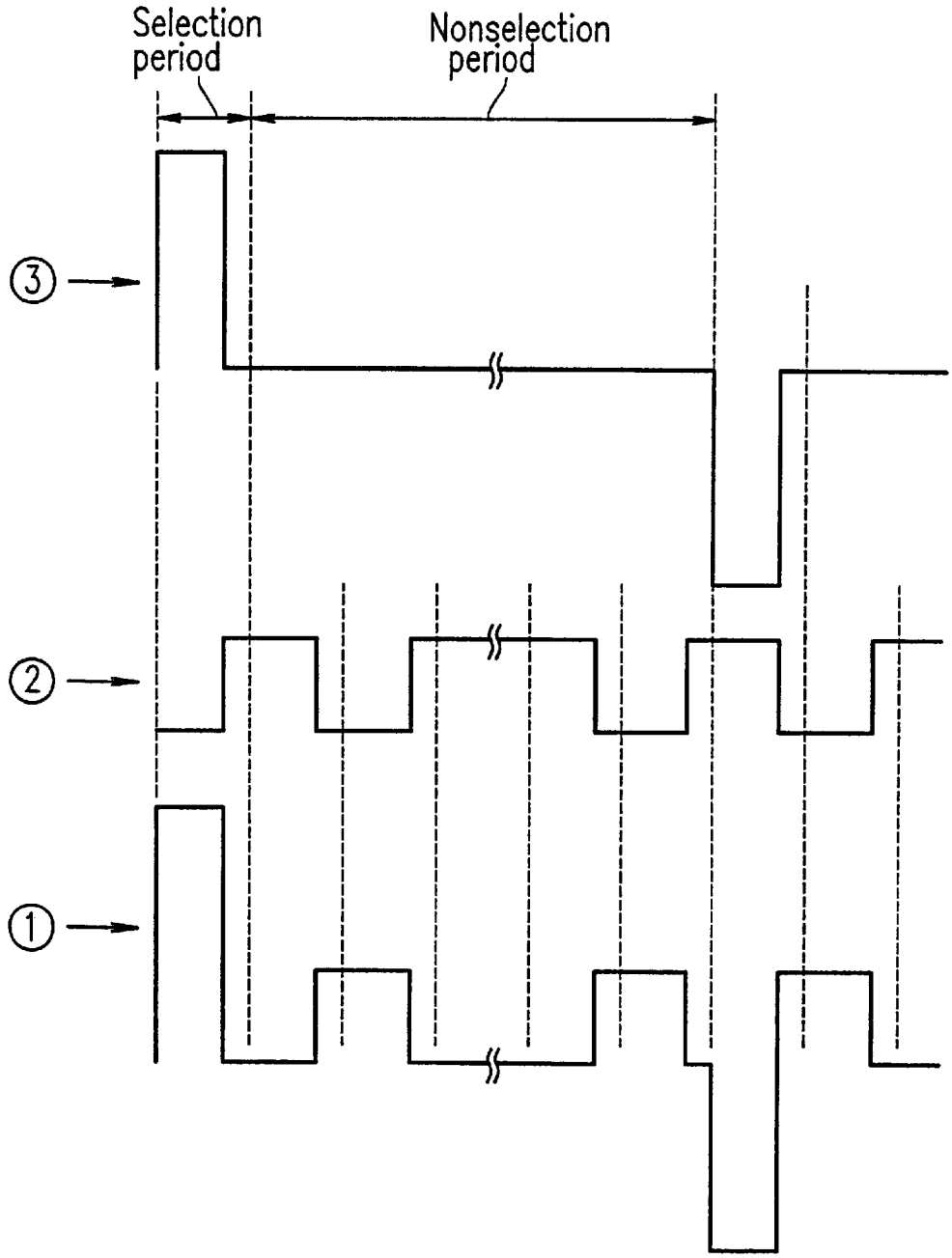
FIG. 10 illustrates waveforms of signals applied to the display device according to an example of the present invention.

Example 2 of the present invention will now be described. In this example, the pulse width of the supply voltage applied to the scanning signal lines and the pulse width of the modulated voltage applied to the data signal lines are changed. FIG. 10 illustrates waveforms applied to the display device according to the present example of the invention. A signal as shown in ② of FIG. 10 is applied to the data signal lines, and a signal as shown in ③ of FIG. 10 is applied to the scanning signal lines, thereby applying a signal as shown in ① of FIG. 10, which is a synthesized signal of signals ② and ③ of FIG. 10, to each pixel in the display panel section.

The synthesized signal shown in ① of FIG. 10 is first set to have a pulse width narrower than the selection period. The pulse width of the synthesized signal is changed corresponding to the ambient temperature so as to be the same pulse width as the selection period, or the widest pulse width, at the lowest temperature in the temperature range used. In the previous example, described with reference to FIG. 6, the correction is performed by decreasing the amplitude of the supply voltage applied to the scanning signal lines and the amplitude of the modulated voltage applied to the data signal lines when the ambient temperature increases. The same effect is achieved by narrowing the pulse widths of the supply voltage and the modulated voltage as indicated by the synthesized signal in ① of FIG. 10. Similarly, in the previous example, described with reference to FIG. 7, the correction is performed by increasing the amplitude of the supply voltage applied to the scanning signal lines and the amplitude of the modulated voltage applied to the data signal lines when the ambient temperature decreases. The same effect is achieved by changing the pulse widths in a manner opposite to that shown in ① of FIG. 10 (i.e., widening the pulse widths). Accordingly, by not changing the amplitudes, but rather the pulse widths, a power loss of the resistors and the operational amplifiers can be reduced further as compared to the case where the amplitudes are changed.

EXAMPLE 3

Figure 11:
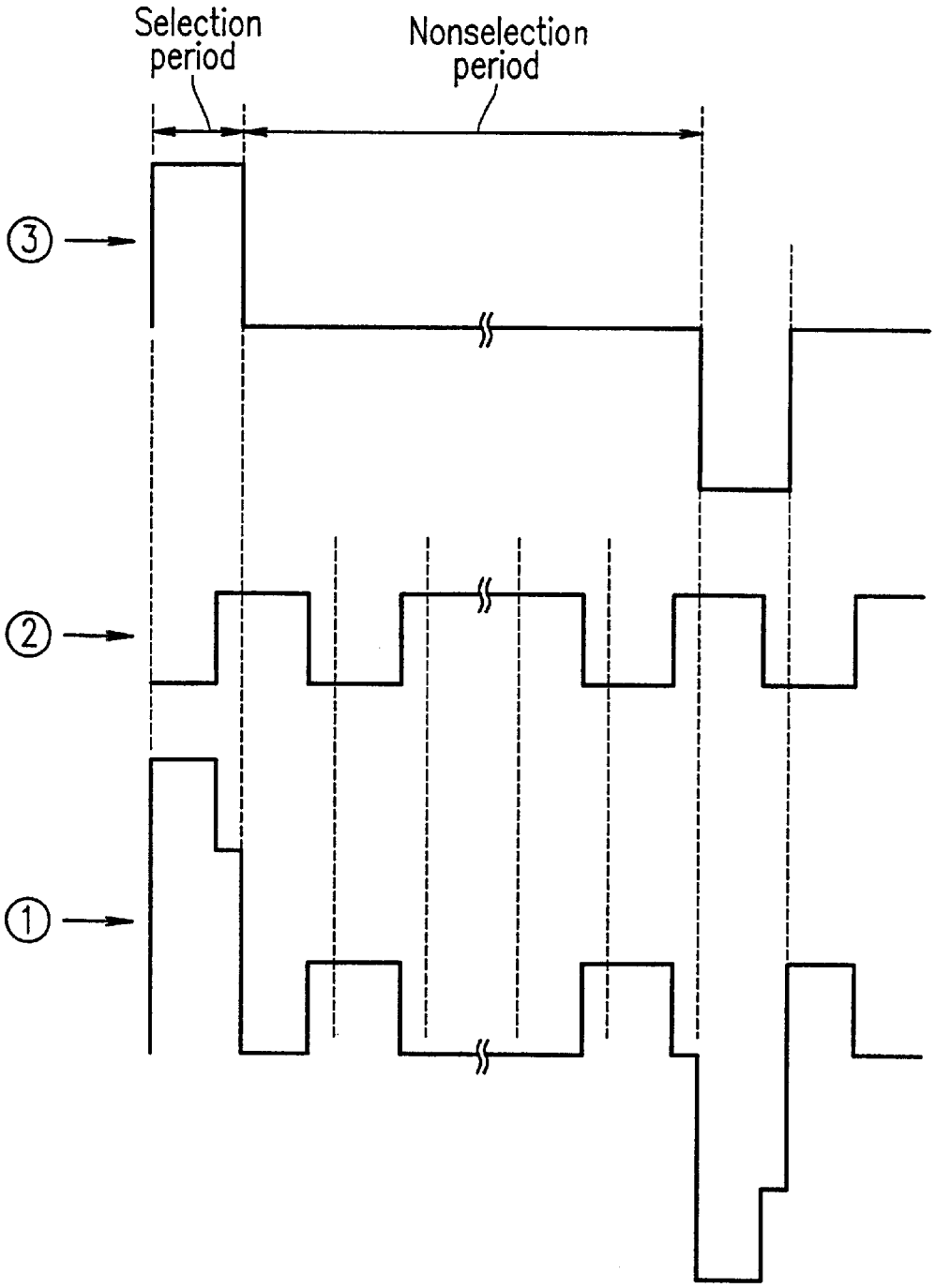
FIG. 11 illustrates waveforms of signals applied to the display device according to an example of the present invention.

Example 3 of the present invention will now be described. In this example, the amplitude of the supply voltage applied to the scanning signal lines and the pulse width of the modulated voltage applied to the data signal lines are changed. FIG. 11 illustrates waveforms applied to the display device according to the present example of the invention. A signal as shown in ② of FIG. 11 is applied to the data signal lines, and a signal as shown in ③ of FIG. 11 is applied to the scanning signal lines. As a result, a signal as shown in ① of FIG. 11, which is a synthesized signal of signals ② and ③ of FIG. 11, is applied to each pixel in the display panel section, to which the dual-terminal nonlinear elements are serially connected. In the previous example described with reference to FIG. 6, the correction is performed by decreasing the amplitude of the supply voltage applied to the scanning signal lines decreasing the amplitude of the modulated voltage applied to the data signal lines when the ambient temperature increases. The same effect is achieved by decreasing the amplitude of the supply voltage which is applied to the scanning signal lines and narrowing the pulse width of the modulated voltage which is applied to the data signal lines as indicated by the synthesized signal in ① of FIG. 11. Similarly, in the previous example, described with reference to FIG. 7, the correction is performed by increasing the amplitude of the supply voltage applied to the scanning signal lines and the amplitude of the modulated voltage applied to the data signal lines when the ambient temperature decreases. The same effect is achieved by changing the amplitude of the supply voltage and the pulse width of the modulated voltage in a manner opposite to that shown in ① of FIG. 11 (i.e., increasing the amplitude of the supply voltage which is applied to the scanning signal lines and widening the pulse width of the modulated voltage which is applied to the data signal lines).

EXAMPLE 4

Figure 12:
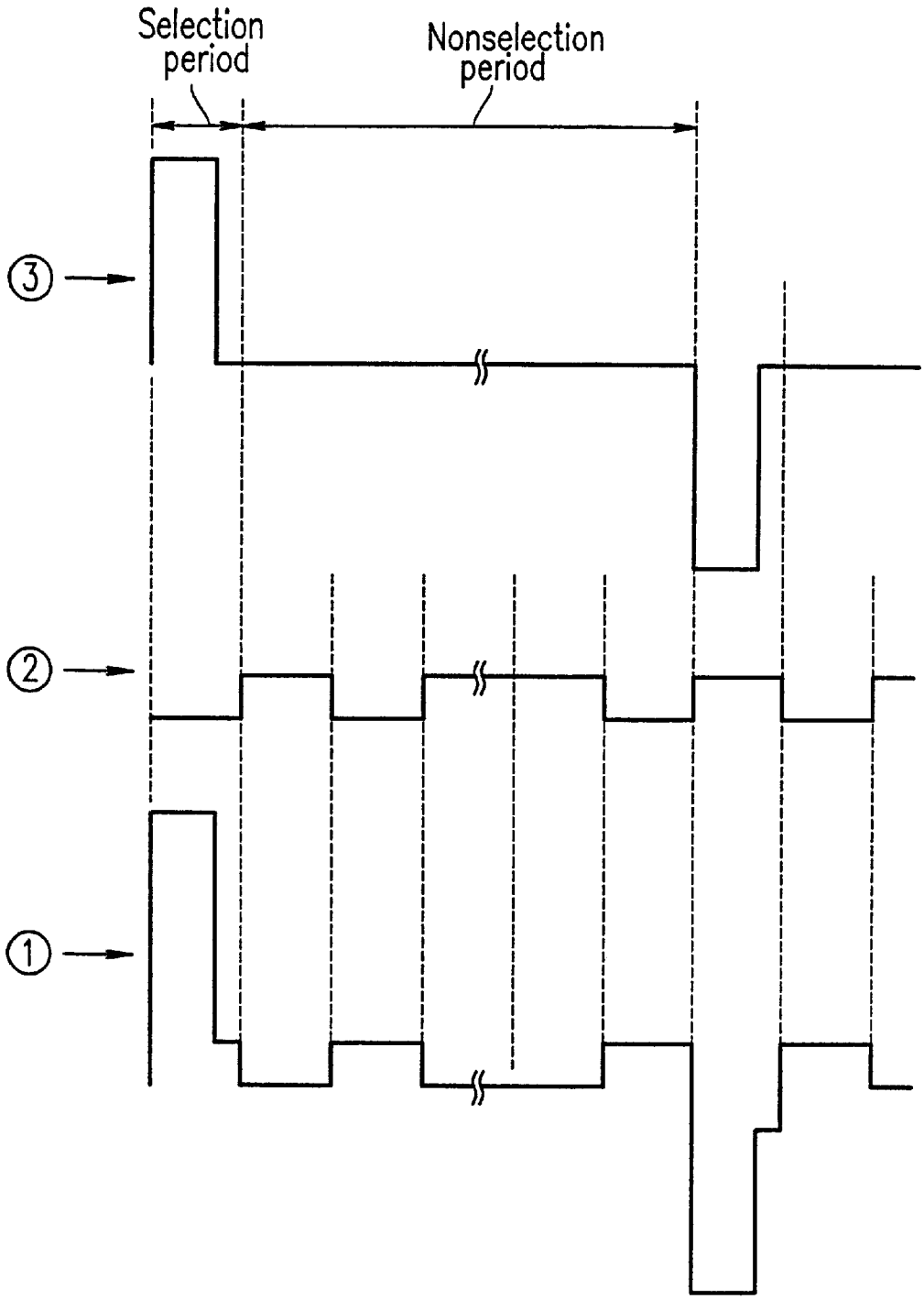
FIG. 12 illustrates waveforms of signals applied to the display device according to an example of the present invention.

Example 4 of the present invention will now be described. In this example, the pulse width of the supply voltage applied to the scanning signal lines and the amplitude of the modulated voltage applied to the data signal lines are changed. FIG. 12 illustrates waveforms applied to the display device according to the present example of the invention. A signal as shown in ② of FIG. 12 is applied to the data signal lines, and a signal as shown in ③ of FIG. 12 is applied to the scanning signal lines. As a result, a signal as shown in ① of FIG. 12, which is a synthesized signal of signals ② and ③ of FIG. 12, is applied to each pixel in the display panel section, to which the dual-terminal nonlinear elements are serially connected. In the previous example, described with reference to FIG. 6, the correction is performed by decreasing the amplitude of the supply voltage applied to the scanning signal lines and the amplitude of the modulated voltage applied to the data signal lines when the ambient temperature increases. The same effect is achieved by narrowing the pulse width of the supply voltage which is applied to the scanning signal lines and decreasing the amplitude of the modulated voltage which is applied to the data signal lines as indicated by the synthesized signal in ① of FIG. 12. Similarly, in the previous example, described with reference to FIG. 7, the correction is performed by increasing the amplitude of the supply voltage applied to the scanning signal lines and the amplitude of the modulated voltage applied to the data signal lines if the ambient temperature decreases. The same effect is achieved by changing the pulse width and the amplitude in a manner opposite to that shown in ① of FIG. 12 (i.e., widening the pulse width of the supply voltage which is applied to the scanning signal lines and increasing the amplitude of the modulated voltage which is applied to the data signal lines).

Note that Examples 1 to 4 merely describe typical examples of the dual-terminal nonlinear elements. It is understood that the above correction methods according to the present invention are applicable to any dual-terminal nonlinear element having any I-V characteristics without deviating from the scope of the invention.

If a dual-terminal nonlinear element employs a MIM structure, the characteristics of the dual-terminal nonlinear elements are determined by parameters such as the permittivity of insulation materials, the insulation resistance, the thickness of the insulation film, and the surface area of the element. Regarding insulation materials, insulation films formed of, e.g., $Ta_2O_5$, $SiN_x$, $SiC_x$ and the like are known for changing their characteristics by being doped with $N_2$, Ar, Kr, and the like. The characteristics of the insulation films can also be changed by the temperature during the film formation or during the annealing after the formation of the insulation film.

Some of such parameters are difficult to control due to interactions between each of the parameters or other reasons. In the examples of the present invention, an insulation film is formed of $Ta_2O_5$, and has a thickness in the range of 300 Å to 800 Å and a surface area in the range of 10 $\mu m^2$ to 100 $\mu m^2$. The film forming temperature is at 200° C. to 300° C.

Since these parameters can be controlled, it is possible to produce dual-terminal nonlinear elements by varying their I-V characteristics, such as elements having a high resistance or elements having a low resistance.

EXAMPLE 5

Example 5 of the present invention will now be described. According to the present example, dual-terminal nonlinear elements having high resistance I-V characteristics are produced. Dual-terminal nonlinear elements having high resistance I-V characteristics can be produced, for example, by increasing the thickness of the insulation film, reducing the surface area of the device, or decreasing the film formation temperature. In the present example, high-resistance dual-terminal nonlinear elements having an insulation film thickness of 500 Å and a surface area of 30 $\mu m^2$ are formed at a film formation temperature of 220° C.

Figure 9:
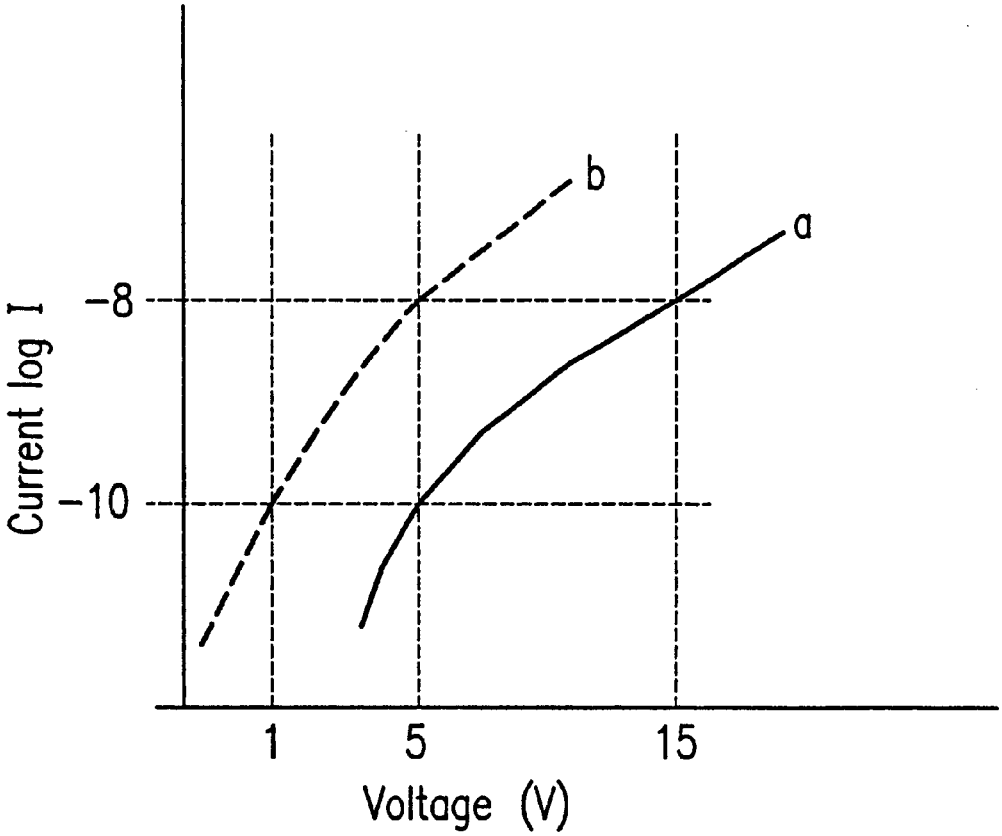
FIG. 9 is a graph illustrating a change in I-V characteristics of the dual-terminal nonlinear element in the display device according to an example of the present invention, corresponding to the temperature change.

The I-V characteristics of the dual-terminal nonlinear elements formed according to the present example are shown by the solid line a in FIG. 9. As can be seen from the graph, the I-V characteristics achieved in this example are a voltage value in a range from 5 V to 15 V at a current value in a range from $1\times10^{-10}$ A to $1\times10^{-8}$ A.

When the normal signal waveform is applied to the above dual-terminal nonlinear elements having a high resistance, a waveform shown in ② of FIG. 7 is obtained. In the present example, as shown in ④ of FIG. 7, the corrected voltage applied to the scanning signal lines is adjusted so as to increase the supply voltage applied to each pixel during the selection period, and the corrected voltage applied to the data signal lines is adjusted so as to increase the modulated voltage applied to each pixel during the nonselection period, thereby setting the amplitude of modulated voltage in a range from 5 V to 15 V.

With respect to the waveform shown in ② of FIG. 7, it is necessary to increase the voltage applied during the selection period. This may result in a white image being made darker, in the case where a normally white display panel is used. This is because the increase of the resistance values of the dual-terminal nonlinear elements causes the maintenance characteristic during the nonselection period to increase, and therefore the residual of the electricity charged during the selection period is maintained during the selection period.

Such a disadvantage can be overcome by increasing the modulated voltage as shown in ④ of FIG. 7, thereby reducing the maintenance characteristic during the nonselection period and thus reducing the residual amount of charge in the white display. As a result, a desired display characteristics can be obtained even in the white display.

In addition, using the high-resistance I-V characteristic dual-terminal nonlinear elements makes it possible to obtain a display with a higher contrast.

EXAMPLE 6

Example 6 of the present invention will now be described. According to the present example, dual-terminal nonlinear elements having low resistance I-V characteristics are produced. The dual-terminal nonlinear elements having low resistance I-V characteristics can be produced, for example, by decreasing the thickness of the insulation film, increasing the surface area of the element, or increasing the film formation temperature. In the present example, low-resistance dual-terminal nonlinear elements having an insulation film thickness of 500 Å and a surface area of 30 $\mu m^2$ are formed at a film formation temperature of 245° C.

The I-V characteristics of the dual-terminal nonlinear elements formed according to the present example are shown by the dashed line b in FIG. 9. As can be seen from the graph, the I-V characteristics achieved in this example are a voltage value in a range from 1 V to less than 5 V at a current value in a range from $1\times10^{-10}$ A to $1\times10^{-8}$ A.

When a normal signal waveform is applied to the above dual-terminal nonlinear elements having a low resistance I-V characteristics, a waveform shown in ② of FIG. 6 is obtained. In the present example, as shown in ④ of FIG. 6, the corrected voltage applied to the scanning signal lines is adjusted so as to decrease the supply voltage applied to each pixel during the selection period, and the corrected voltage applied to the data signal lines is adjusted so as to decrease the modulated voltage applied to each pixel during the nonselection period, thereby setting the amplitude of modulated voltage in a range from 1 V to less than 5 V.

In order to obtain the waveform shown in ② of FIG. 6, it is necessary to decrease the voltage applied during the selection period. This may result in a black image being made slightly whitish, in the case where a normally white display panel is used. This is because the decrease of the resistance values of the dual-terminal nonlinear elements causes the maintenance characteristic during the nonselection period to decrease, and therefore the electricity which has been charged during the selection period decreases. Such a disadvantage can be overcome by decreasing the modulated voltage as shown in ④ of FIG. 6, thereby preventing the decrease of the maintenance characteristic during the nonselection period. As a result, an appropriate display can be achieved in the case of a black display.

In addition, using the low-resistance I-V characteristic dual-terminal nonlinear elements makes it possible to obtain a display with a good display uniformity without having irregularities.

In the above examples, the present invention is implemented in a liquid crystal display device, which employs a liquid crystal as a display medium. Alternatively, the present invention is also applicable to display devices employing another display medium, e.g., EL (electroluminescence), EC (electrochromic), or the like. Furthermore, the dual-terminal nonlinear elements are not limited to MIM elements. Other dual-terminal nonlinear elements, such as varistor, back to back diode, diode ring, etc., can alternatively be used.

As described in detail above, the present invention makes it possible to provide a display device employing dual-terminal nonlinear elements, which has an excellent display quality and is less likely to be affected by ambient temperature changes. Furthermore, by incorporating dual-terminal nonlinear elements having high resistance I-V characteristics in a display device having many scanning lines, it is possible to provide a display device having an improved contrast even if the selection period is reduced. Moreover, by incorporating dual-terminal nonlinear elements having low resistance I-V characteristics, it is possible to provide a display device having a characteristic which is suitable for a grading display emphasizing uniformity, and is possible to use driving circuit parts which have a low level voltage tolerance, thereby reducing the device cost.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for driving a display device, comprising a pair of substrates disposed so as to face each other with a display medium inserted therebetween, a first substrate comprising: a first wiring of either a plurality of scanning lines or a plurality of signal lines; and at least one dual-terminal nonlinear element which is connected to the first wiring and functions as a switching element for selecting matrix arranged pixels, and a second substrate comprising a second wiring of another of the plurality of scanning lines or the plurality of signal lines provided in a direction perpendicular to the first wiring, the method comprising the step of altering an amplitude of a supply voltage applied to each of the pixels during a selection period and an amplitude of a modulated voltage applied to each of the pixels during a nonselection period, corresponding to an ambient temperature level, wherein the amplitude of the supply voltage and the amplitude of the modulated voltage are decreased in a case where the ambient temperature increases, and the amplitude of the supply voltage and the amplitude of the modulated voltage are increased in a case where the ambient temperature decreases, and the rate of amplitude change of the modulated voltage to the change of the ambient temperature is greater than the rate of amplitude change of the supply voltage to the change of the ambient temperature.

2. A method for driving the display device according to claim 1, wherein the at least one dual-terminal nonlinear element has a MIM structure.

3. A method for driving a display device, comprising a pair of substrates disposed so as to face each other with a display medium inserted therebetween, a first substrate comprising: a first wiring of either a plurality of scanning lines or a plurality of signal lines; and at least one dual-terminal nonlinear element which is connected to the first wiring and functions as a switching element for selecting matrix arranged pixels, and a second substrate comprising a second wiring of another of the plurality of scanning lines or the plurality of signal lines provided in a direction perpendicular to the first wiring, the method comprising the step of altering a pulse width of a supply voltage applied to each of the pixels during a selection period and a pulse width of a modulated voltage applied to each of the pixels during a nonselection period, corresponding to an ambient temperature, wherein the pulse width of the supply voltage and the pulse width of the modulated voltage are decreased in a case where the ambient temperature increases, and the pulse width of the supply voltage and the pulse width of the modulated voltage are increased in a case where the ambient temperature decreases.

4. A method for driving the display device according to claim 3, wherein the at least one dual-terminal nonlinear element has a MIM structure.

5. A method for driving a display device, comprising a pair of substrates disposed so as to face each other with a display medium inserted therebetween, a first substrate comprising: a first wiring of either a plurality of scanning lines or a plurality of signal lines; and at least one dual-terminal nonlinear element which is connected to the first wiring and functions as a switching element for selecting matrix arranged pixels, and a second comprising a second wiring of another of the plurality of scanning lines or the plurality of signal lines provided in a direction perpendicular to the first wiring, the method comprising the step of altering an amplitude of a supply voltage applied to each of the pixels during a selection period and a pulse width of a modulated voltage applied to each of the pixels during a nonselection period, corresponding to an ambient temperature level, wherein the amplitude of the supply voltage and the pulse width of the modulated voltage are decreased in a case where the ambient temperature increases, and the amplitude of the supply voltage and the pulse width of the modulated voltage are increased in a case where the ambient temperature decreases.

6. A method for driving the display device according to claim 5, wherein the at least one dual-terminal nonlinear element has a MIM structure.

7. A method for driving a display device, comprising a pair of substrates disposed so as to face each other with a display medium inserted therebetween, a first substrate comprising: a first wiring of either a plurality of scanning lines or a plurality of signal lines; and at least one dual-terminal nonlinear element which is connected to the first wiring and functions as a switching element for selecting matrixarranged pixels, a second substrate comprising a second wiring of the other of the plurality of scanning lines or the plurality of signal lines provided in a direction perpendicular to the first wiring, the method comprising the step of altering a pulse width of a supply voltage applied to each of the pixels during a selection period and an amplitude of a modulated voltage applied to each of the pixels during a nonselection period, corresponding to an ambient temperature level, wherein the pulse width of the supply voltage and the amplitude of the modulated voltage are decreased in a case where the ambient temperature increases, and the pulse width of the supply voltage and the amplitude of the modulated voltage are increased in a case where the ambient temperature decreases.

8. A method for driving the display device According to claim 7, wherein the at least one dual-terminal nonlinear element has a MIM structure.

9. A method for driving a display device, comprising a pair of substrates disposed so as to face each other with a display medium inserted therebetween, a first substrate, comprising: a first wiring of either a plurality of scanning ines or a plurality of signal lines; and at least one dual-terminal nonlinear element which is connected to the first wiring and functions as a switching element for selecting matrix arranged pixels, a second substrate comprising a second wiring of another of the plurality of scannning lines or the plurality of signal lines provided in a direction perpendicular to the first wiring, wherein the amplitude of the supply voltage and the amplitude of the modulated voltage are altered corresponding to a current/voltage characteristic of the at least one dual-terminal nonlinear element, and wherein the amplitude of the supply voltage and the amplitude of the modulated voltage are increased in a case where the current/voltage characteristic of the dual-terminal nonlinear element is set to a high resistance current/voltage characteristic, and the amplitude of the supply voltage and the amplitude of the modulated voltage are decreased in a case where the current/voltage characteristic of the at least one dual-terminal nonlinear element is set to a low resistance current/voltage characteristic.

10. A method for driving the display device according to the claim 9, wherein the amplitude of the modulated voltage is in a range from 5 V to 15 V in a case where the current/voltage characteristic of the at least one dual-terminal nonlinear element is set so that a voltage value of the current/voltage characteristic is in a range from 5 V to 15 V at a current value of the current/voltage characteristic in a range of $1\times10^{-10}$ A to $1\times10^{-8}$ A, and the amplitude of the modulated voltage is in a range from 1 V to less than 5 V in a case where the current/voltage characteristic of the at least one dual-terminal nonlinear element is set so that the voltage value of the current/voltage characteristic is in a range from 1 V to less than 5 V at the current value of the current/voltage characteristic in a range from $1\times10^{-10}$ A to $1\times10^{-8}$ A.

11. A method for driving the display device according to claim 10, wherein the at least one dual-terminal nonlinear element has a MIM structure.

12. A method for driving the display device according to claim 9, wherein the at least one dual-terminal nonlinear element has a MIM structure.

* * * * *